US005309816A

United States Patent [19]

Weyer

[11] Patent Number: 5,309,816

[45] Date of Patent: May 10, 1994

[54] ROTARY ACTUATOR WITH EXTERNAL BEARINGS

[76] Inventor: Paul P. Weyer, P.O. Box 398, Enumclaw, Wash. 98022

[21] Appl. No.: 55,035

[22] Filed: Apr. 27, 1993

[51] Int. Cl.[5] ..... F01B 3/00

[52] U.S. Cl. ..... 92/32; 92/33; 92/111; 92/116

[58] Field of Search ..... 92/31, 32, 33, 116, 92/111

[56] References Cited

U.S. PATENT DOCUMENTS

| | | | |
|---|---|---|---|
| 2,632,426 | 3/1953 | Geesink | 92/33 |
| 2,959,064 | 11/1960 | Geyer et al. | 92/33 |
| 3,530,769 | 9/1970 | Gurevich | 92/111 |
| 4,508,016 | 4/1985 | Weyer | 92/33 |
| 4,513,644 | 4/1985 | Weyer . | |
| 4,741,250 | 5/1988 | Weyer | 92/33 |
| 4,881,419 | 11/1989 | Weyer | 74/89.15 |
| 4,987,825 | 1/1991 | Weyer | 92/2 |
| 5,027,667 | 7/1991 | Weyer | 74/89.15 |
| 5,038,672 | 8/1991 | Beuschau | 92/116 |

FOREIGN PATENT DOCUMENTS

| | | | |
|---|---|---|---|
| 1121475 | 1/1962 | Fed. Rep. of Germany | 92/31 |
| 2227113 | 12/1973 | Fed. Rep. of Germany | 92/31 |

*Primary Examiner*—Thomas E. Denion

*Attorney, Agent, or Firm*—Seed and Berry

[57] ABSTRACT

A fluid-powered rotary actuator having a body adapted for coupling to a movable member to transfer rotational force thereto. A drive member includes a flange extending axially outward from a body first end, and a stub shaft extending coaxially within the body toward a body second end. The flange includes first, second and intermediate portions, with the first portion axially outward of the second portion. The second portion has a ball race, the first portion is threaded, and the intermediate portion has straight splines formed thereon. The drive member has an elongated aperture, and first and second fluid conduits formed therein. A fluid-transfer tube is carried by a piston and extends into the central aperture. Pressurized fluid applied to a flange first port is communicated through the first fluid conduit to a first piston side, and pressurized fluid applied to a flange second port is communicated through the second fluid conduit via the transfer tube to a second piston side. A mounting member is adapted for coupling to a support frame to transfer rotational force thereto. The mounting member has an aperture with straight splines which mesh with the intermediate portion straight splines to permit adjusting longitudinal movement of the mounting member relative to the flange while holding the flange stationary against rotation relative to the support frame.

37 Claims, 3 Drawing Sheets

ROTARY ACTUATOR WITH EXTERNAL BEARINGS

TECHNICAL FIELD

The present invention relates generally to actuators, and more particularly, to fluid-powered rotary actuators in which axial movement of a piston results in relative rotational movement between a body and a shaft.

BACKGROUND OF THE INVENTION

Rotary helical splined actuators have been employed in the past to achieve the advantage of high-output from a simple linear piston-and-cylinder drive arrangement. The actuator typically uses a cylindrical body with an elongated rotary shaft extending coaxially within the body, with an end portion of the shaft providing the drive output. An elongated piston sleeve has an outer sleeve portion splined to cooperate with corresponding splines on the body interior or a ring gear, and an inner sleeve portion splined to cooperate with corresponding splines on the shaft exterior. The piston sleeve is reciprocally mounted within the body with the shaft extending therewithin, and has a head for the application of fluid pressure to one or the other opposing sides thereof to produce axial movement of the piston sleeve.

As the piston sleeve linearly reciprocates in an axial direction within the body, the splines of the outer sleeve portion engage the splines of the body to cause rotation of the piston sleeve. The resulting linear and rotational movement of the piston sleeve is transmitted through the splines of the inner sleeve portion to the splines of the shaft to cause the shaft to rotate. Bearings are typically positioned interior of the body to rotatably support one or both ends of the shaft relative to the body.

While such an arrangement produces a relatively high-torque output, the capability of the actuator to support high moment loads and large axial and radial thrust loads has been limited. The actuator typically has a slender shaft with bearings between the shaft and end flanges or end caps of the body, with the bearings positioned radially inward of the body sidewall. It is desirable to use rotary actuators to rotate heavy loads and loads that produce large bending movements. For example, a rotary actuator may be used to rotate a large-diameter platform which extends radially far beyond the actuator body and which carries a crane, bucket lift or other mechanism having a boom reaching far outward of the platform. Once such arrangement is shown in the inventor's U.S. Pat. No. 4,508,016.

The conventional actuator is not well constructed to handle the high moments encountered when the shaft centrally supports a platform, since it does so in an almost needle point balanced arrangement. In such an arrangement, when the boom of the device carried by the platform is extended, the moments become extremely large and difficult for the conventional actuator shaft and shaft bearing configuration to handle. Further, the axial thrust loads encountered due to the weight of the platform, the crane, or other mechanism mounted thereon, and the workload it carries, are far too great for the conventional actuator shaft bearing configurations. Other uses of the actuator are envisioned which also subject the actuator shaft to high moments and large axial thrust loads, such as use to rotate a log grapple or to steerably turn the wheel assembly of a vehicle while supporting the weight of the vehicle above the wheel assembly.

A shortcoming of conventional actuators with bearings supporting the shaft at both ends of the body is that if a large bending load is transmitted through the shaft, such as when supporting a crane platform, any resulting radial movement or bowing of the shaft can cause the shaft, the piston sleeve and the ring gear to bind. This may inhibit operation of the actuator and damage the actuator. While increasing the size of the shaft and the bearings helps reduce the shaft movement and bowing that occurs under such loads, and hence the resulting binding, the result is a heavy and expensive actuator.

Another problem involves the cost of manufacturing actuators, especially ones designed to handle high moments and large axial and radial loads. In the past the actuator body has typically been designed with a thick wall construction, and since the bearing races are formed in the body sidewall of the actuator, the body must be hardened. The result is a heavy and expensive body. Even in lighter load applications where a thin-wall body construction is used, end caps with a plurality of the rods extending therebetween are often needed.

It will therefore be appreciated that there has long been a significant need for fluid-powered rotary actuators capable of handling increased moments and axial and radial shaft loads. The actuator should have a compact and lightweight design which allows use of a thin wall body construction without requiring use of tie rods. The actuator should be economical to manufacture. Preferably, the actuator should be able to operate even under large bending loads that produce some bowing of the shaft. The actuator should also permit preloading of the bearings which rotatably support the shaft with respect to the body without requiring disassembly of the actuator. Also, the actuator should provide for smooth start up and stopping action as the piston sleeve reaches its end limits of axial travel. Finally, the actuator should provide convenient means for attachment of hydraulic hoses that avoids twisting and damage of the hoses. The present invention fulfills these needs and further provides other related advantages.

SUMMARY OF THE INVENTION

The present invention resides in a fluid-powered rotary actuator to produce relative rotational movement between first and second members. The actuator includes a body having a longitudinal axis, and first and second ends. The body is adapted for coupling to the first member to transfer rotational force thereto. The actuator has a shaft with a first portion positioned at and extending axially outward of the body beyond the body first end, and a second portion extending longitudinally and generally coaxially within the body toward the body second end. The shaft first portion is fixedly attached to the shaft second portion. The shaft first portion has first and second end portions, with the second end portion of the shaft first portion being toward the body first end, and the first end portion of the shaft first portion being axially outward of the body first end. The shaft first portion also has an intermediate portion between the first and second end portions of the shaft first portion and axially outward of the body first end. The second end portion of the shaft first portion has an axially outward-facing bearing race formed thereon extending circumferentially thereabout. The intermediate portion of the shaft first portion has at least one torque-transmitting element.

A mounting member is also provided with the actuator and is adapted for coupling to the second member to transfer rotational force thereto. The mounting member has an aperture with the intermediate portion of the shaft first portion extending therethrough, and at least one second torque-transmitting element engaging the first torque-transmitting element of the intermediate portion to transmit rotational force therebetween while permitting adjusting longitudinal movement of the mounting member relative to the shaft first portion. The mounting member has an axially inward-facing bearing race formed thereon about the mounting member aperture.

An adjustable member is mounted on the first end portion of the shaft first portion axially outward of the mounting member and engaging the mounting member to limit axial outward movement of the mounting member relative to the shaft first portion. The adjustable member is adjustably axially positionable on the first end portion.

An annular bearing carrier is mounted coaxially with and fixedly attached to the body at the body first end axially outward of the body first end. The carrier has a central aperture with the shaft first end portion extending therethrough. The carrier further has an axially inward-facing bearing race formed thereon about the carrier aperture and confronting and conforming to the second end portion bearing race to form a first set of races extending circumferentially about the shaft first portion at the body first end to rotatably support the shaft and limit outward longitudinal movement of the shaft. The carrier also has an axially outward-facing bearing race formed thereon about the carrier aperture and confronting and conforming to the mounting member bearing race to form a second set of races extending circumferentially about the shaft first portion axially outward of the first set of races to rotatably support the shaft and limit inward longitudinal movement of the shaft. The first and second sets of races provide the rotational support for the shaft relative to the body at a location at or outward of the body first end, with adjustable axial inward positioning of the adjustable member on the first end portion of the shaft first portion preloading the first and second sets of races. One or more bearings are seated in each of the first and second sets of races.

A piston is mounted for reciprocal longitudinal movement within the body in response to selective application of pressurized fluid thereto. A torque-transmitting member is also mounted for reciprocal longitudinal movement within the body. The torque-transmitting member engages the body and the shaft second portion to translate longitudinal movement of the piston toward one of the body first or second ends into clockwise rotational movement between the shaft and the body, and longitudinal movement of the piston toward the other of the body first or second ends into counterclockwise relative rotational movement between the shaft and the body. As such, relative rotational movement between the first and second members results.

In the illustrated body of the invention, the shaft has an elongated central aperture extending coaxially with the shaft and the piston. The central aperture has an opening at a shaft free end. The shaft further has a first fluid conduit formed therein to provide fluid communication between the piston first side and a first port formed in the shaft at a location exterior of the body. A second fluid conduit is also formed in the shaft to provide fluid communication between the central aperture and a second port formed in the shaft at a location exterior to the body.

In this embodiment, a fluid transfer tube is carried by the piston as the piston moves within the body. The tube extends through the shaft free-end opening and into the shaft central aperture for reciprocal longitudinal movement therewithin as the piston longitudinally reciprocates within the body. The tube has a fluid conduit with a first opening in a free-end portion of the tube positioned within the central aperture, and a second opening at a position in fluid communication with the piston second side to provide fluid communication between the second port and the piston second side. The selective application of pressurized fluid to the first port applies pressurized fluid to the piston first side to move the piston toward the body second side. The selective application of pressurized fluid to the second port applies pressurized fluid to the piston second side to move the piston toward the body first end.

In the illustrated embodiment, the tube first opening includes a first orifice in a sidewall of the tube toward an end thereof away from the piston, and the central aperture has a reduced-diameter interior sidewall portion toward the shaft free end. The reduced-diameter sidewall portion is sized and positioned such that when the piston is in position toward an end limit of travel toward the body second end, the first orifices within the reduced-diameter sidewall portion and the reduced-diameter sidewall portion at least partially blocks the flow of fluid through the first orifice.

The shaft first fluid conduit also includes a first orifice which is formed in a sidewall of the central aperture at an end portion thereof toward the shaft free-end opening. Further, a seal is located within the central aperture and axially positioned between the shaft first orifice and an end limit of travel position of the tube first opening reached with the piston reaches an end limit of travel toward the body second end. The seal provides a fluid-tight seal between the shaft and the tube. The tube has an enlarged-diameter exterior sidewall portion toward the piston. The enlarged-diameter sidewall portion is sized and positioned such that when the piston is in position toward an end limit of travel toward the body first end, the first orifices within the enlarged-diameter sidewall portion and the enlarged-diameter sidewall portion at least partially blocks the flow of fluid through the first orifice.

In another embodiment of the invention, the transfer tube is supported by the shaft second portion in coaxially alignment with the piston. In this embodiment, the tube extends from the shaft free end through a piston central aperture to permit reciprocal longitudinal movement of the piston within the body and about the tube.

It is noted that the bearing arrangement of the present invention may be used without a fluid-transfer tube, and similarly, the fluid-transfer tube of the present invention can be used without the bearing arrangement. Other features and advantages of the invention will become apparent from the following detailed description, taken in conjunction with the accompanying drawings.

DETAILED DESCRIPTION OF THE INVENTION

Figure 1:
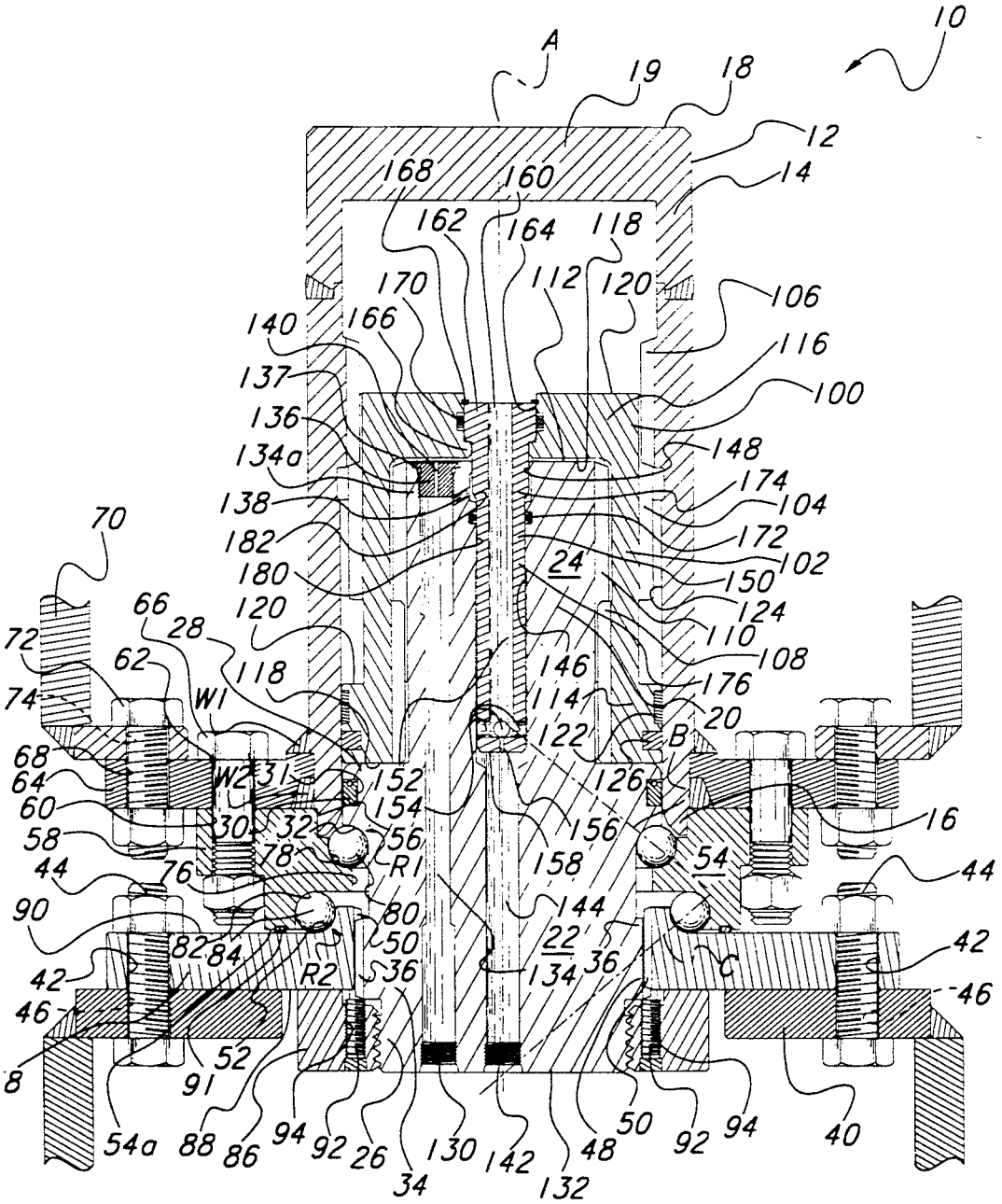
FIG. 1 is a side elevational, sectional view of a fluid-powered rotary splined actuator embodying the present invention.
Figure 2:
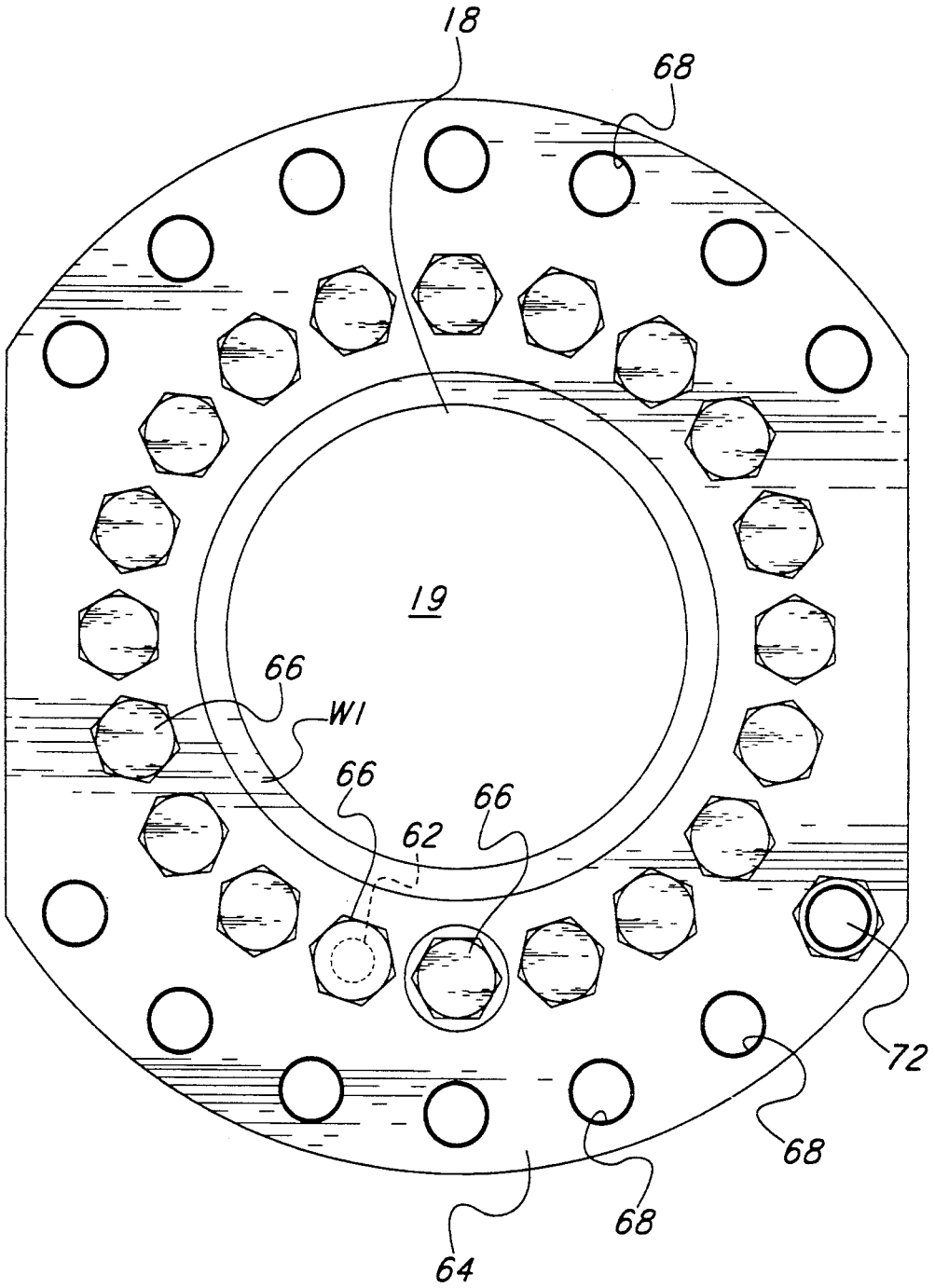
FIG. 2 is an enlarged top plan view of the actuator of FIG. 1 shown disconnected from all external members.

As shown in the drawings for purposes of illustration, the present invention is embodied in a fluid-powered rotary actuator 10. The actuator 10 includes an elongated housing or body 12 having a cylindrical sidewall 14, and first and second ends 16 and 18, respectively. The body 12 has a relatively thin-wall tubular construction using a low-carbon weldable steel which has not been hardened. A circular end wall 19 closes the body 12 at the body second end 18. A rotary output stub shaft 20 is coaxially positioned within the body 12 and supported for rotation relative to the body about a common longitudinal axis "A", as well as described in more detail below.

The shaft 20 includes a flange portion 22 positioned at the body first end 16 closing the body 12 at the body first end, and an elongated splined portion 24 axially extending from the flange portion toward the body second end 18. The shaft flange portion 22 has a diameter larger than the shaft splined portion 24 so as to extend radially outward beyond the shaft splined portion. The shaft flange 22 and the shaft splined portion 24 are formed as an integral unit such as from a single piece of machined stock.

The shaft flange portion 22 extends axially outward beyond the body first end 16 and terminates in a threaded first end portion 26. The shaft flange portion 22 also includes a second end portion 28 located partially within the body 12 at the body first end 16 and projecting out of the body first end. The flange second end portion 28 carries a conventional seal 30 disposed in a circumferential groove 31 in the flange second end portion to provide a fluid-tight seal between the shaft flange portion 22 and the body 12.

The shaft flange portion 22 includes an intermediate portion 34 located between the flange first and second end portions 26 and 28, and axially outward of the body first end 16. The flange intermediate portion 34 has a plurality of axially extending straight splines 36 formed thereon.

The flange second end portion 28 has an axially outward-facing, circular ball race 32 formed thereon at a location between the seal 30 and the straight splines 36 of the flange intermediate portion 34. The flange portion ball race 32 is formed adjacent to the body first end 16. It is noted that the ball race 32 may be found directly on the flange second end portion 28 as shown, or on an annular ball race insert carried by the flange second end portion.

The actuator 10 further includes a circular mounting flange plate 38 for attachment to an external device such as a support frame 40 which carries a supply (not shown) of pressurized fluid. The mounting plate 38 has a plurality of circumferentially spaced-apart mounting holes 42 by which the mounting plate may be fixedly attached to the support frame 40 using a plurality of bolts 44. The bolts 44 extend through the mounting holes 42 of the mounting plate 38 and corresponding holes 46 provided in the support frame 40.

The mounting plate 38 has a central aperture 48 through which the flange intermediate portion 34 extends. The mounting plate aperture 48 has a plurality of axially aligned straight splines 50 which mesh with the straight splines 36 of the flange intermediate portion 34. The intermeshing straight splines 36 and 50 permit adjustable longitudinal movement of the flange intermediate portion 34 relative to the mounting plate 38 while preventing relative rotation between the shaft 20 and the mounting plate and the support frame 40 to which it is fixedly attached. The mounting plate 38 further includes an axially inward-facing, circular ball race 52 formed thereon about the mounting plate aperture 48.

The actuator 10 has an annular bearing carrier 54 mounted coaxially with the body 12 and the shaft 20 about the longitudinal axis A. The bearing carrier 54 is mounted at the body first end 16 and has an annular recess 56 into which the body sidewall 14 at the body first end projects. The bearing carrier 54 extends axially outward away from the body first end 16.

The bearing carrier 54 has a circumferentially extending flange portion 58 with a plurality of circumferentially spaced-apart mounting holes 60 which correspond to mounting holes 62 provided in a body-mounting flange plate 64. With the body 12 so constructed of weldable steel, the body mounting plate 64 can be conveniently welded directly to the body 12. The bearing carrier 54 is fixedly attached to the body mounting plate 64 by a plurality of bolts 66 which extend through the corresponding mounting holes 60 and 62. In the illustrated embodiment the body mounting plate 64 is fixedly attached to the body sidewall 14 towards the body first end 16 by welds W1 and W2. In such fashion, the bearing carrier 54 and the body 12 move as a unit. In an alternative embodiment not illustrated, recess 56 of the bearing carrier 54 may be threaded and threadably received on a threaded end portion (not shown) of the body sidewall 14 at the body first end 16 to provide a more direct connection to the body 12.

The body mounting plate 64 is also provided with a plurality of circumferentially spaced-apart mounting holes 68 positioned radially outward of its mounting holes 62. The mounting holes 68 are provided for attachment of the body 12 to an external device 70, such as a rotatable platform, to which the rotational drive provided by the body is to be transmitted. The body mounting plate 64 is fixedly attached to the rotatable external device 70 by a plurality of bolts 72 which extend through the mounting holes 68 and a plurality of mounting holes 74 provided in the external device which correspond to the mounting holes 68.

The ball carrier 54 has a smooth-walled central aperture 76 larger in diameter from the diameter of the flange portion 22 through which the flange portion extends and out of direct contact with the flange portion. The bearing carrier 54 has an axially inward-facing circular ball race 78 formed thereon about the carrier aperture 76, with the ball race 78 confronting and corresponding to the flange portion ball race 32 to form a first set of races R1 extending circumferentially about the flange portion 22 at the body first end 16. A plurality of steel ball bearings 80 are seated in this first set of races to rotatably support the shaft 20 relative to the body 12 and limit outward longitudinal movement of the shaft.

The bearing carrier 54 is also provided with an axially outward-facing, circular ball race 82 formed thereon about the carrier aperture 76, with the ball race 82 confronting and corresponding to the mounting plate ball race 52 to form a second set of races R2 extending circumferentially about the flange portion 22 axially outward of the body first end 16 and the first set of races R1. A plurality of steel ball bearings 84 are seated in this second set of races formed to rotatably support the shaft 20 relative to the body 12 and limit inward longitudinal movement of the shaft. The first and second sets of races R1 and R2 provide the full rotational support for the shaft 20 relative to the body 12 at a location at or generally outward of the body first end 16.

A retaining nut 86 is threadably mounted on the threaded flange first end portion 26 axially outward of the mounting plate 38. The retaining nut 86 has a diameter sufficient to engage an axially outward face 88 of the mounting plate 38 when the retaining nut is tightened on the threaded flange first end portion 26. The retaining nut 86 is adjustably rotatable on the threaded flange first end portion 26 to longitudinally move the retaining nut axially inward to preload the first and second sets of races R1 and R2. Clearance is provided between an axially outward face 54*a* of the bearing carrier 54 and an axially inward face 90 of the mounting plate 38 to provide for the required axial movement of the mounting plate 3 relative the bearing carrier. A seal 91 is disposed between the axially outward face 54*a* of the bearing carrier 54 and the axially inward face 90 of the mounting plate 58, and extends about the second set of races R2 formed by the mounting member ball race 52 and the bearing carrier ball race 82 to provide a fluid-tight seal between the bearing carrier and the mounting plate 38.

As the retaining nut 86 is tightened on the threaded flange first end portion 26, the shaft 20 is pulled in the axially outward direction relative to the body 12 to bring the flange portion ball races 32 into firm seated engagement with the bearing carrier ball race 78 to eliminate any slack and preload the first set of races R1. Similarly, this adjustment of the retaining nut 86 also moves the mounting plate 38 in the axially inward direction toward the bearing carrier 54 bring the mounting plate ball race 52 into firm seated engagement with the bearing carrier ball race 82 to eliminate any slack and preload the second set of races R2.

Once the retaining nut 86 has been sufficiently tightened on the threaded flange first end portion 26 to remove all slack and preload the first and second sets of races to the extent desired, the retaining nut is locked in position relative to the threaded flange first end portion by a plurality of set screws 92, which are disposed in a plurality of circumferentially spaced-apart threaded apertures 94 in the retaining nut 86. The set screws 92 can be rotated so as to project axially inward and engage the flange intermediate portion 34 to prevent rotational movement of the retaining nut 86 on the threaded flange first end portion 26 during normal operation of the actuator 10. The described clamping action of the bearing carrier 54 between the flange second end portion 28 and the mounting plate 38 resulting from adjustment of the retaining nut 86 provides a convenient means for preloading the first and second sets of races R1 and R2 without disassembling the actuator 10.

It is noted that the straight splines 36 and 50 of the flange intermediate portion 34 and the mounting plate 38 permit the axial adjusting movement of the shaft 20 relative to the mounting plate 38 while preventing any relative rotational movement between the shaft 20 and the mounting plate 38, and hence between the shaft and the support frame 40. As such, any relative rotation between the body 12 and the shaft 20 results in the rotation of the rotatable external device 70.

The bearing carrier ball races 78 and 82 are hardened, as are the flange second end ball race 32 and the mounting plate ball race 52, thereby avoiding the need to manufacture the body sidewall 14 with a wall size sufficiently thick to form ball races therein and the need to harden to the body sidewall to form the ball races. In the past, the body of rotary actuators has been fabricated from a hardened steel to permit the cutting of ball bearing races therein. Since welds made to high-carbon hardened steel do not stand up well under large loads, such as are encountered with rotary actuators, mounting and attachment brackets and flanges could not be welded directly to the body. This made the attachment of the actuator body to the external device being driven or the frame structure supporting the actuator more difficult than desired, and increased the overall cost of manufacture of the actuator. The present invention eliminates the need to fabricate the body 12 from high-carbon steel with ball bearing races cut therein. As such, the body can be constructed from an inexpensive, low-carbon weldable steel.

It should be understood that while the embodiment of FIG. 1 has been described using ball races 32, 54, 78 and 82 to form the first and second set of races R1 and R2, and balls seated in the races, the principle of the invention is equally applicable to races formed for roller bearings or any other suitable form of bearings.

It should also be understood that the invention may be practiced with the shaft 20 rotatably driving an external device rather than the body 12, as was described for the embodiment of FIG. 1. In that situation, the shaft 20 would be attached to the rotatable external device 70 and the body 12 attached to the support frame 40.

The actuator 10 has a conventional linear-to-rotary transmission means which includes a piston sleeve 100 reciprocally mounted within the body 12 coaxially with the body and the shaft 20 about the longitudinal axis A. The piston sleeve 100 has an annular sleeve portion 102 which receives the shaft splined portion 24 therewithin. The sleeve portion 102 has outer helical splines 104 over a portion of its length which mesh with inner helical splines 106 formed on the interior of the body sidewall 14. The sleeve portion 102 is also provided with inner helical splines 108 which mesh with outer helical splines 110 provided on the splined shaft portion 24. It should be understood that while the embodiment of FIG. 1 has been described using helical splines, the principle of the invention is equally applicable to any form of linear-to-rotary motion conversion means, such as balls or rollers.

In the embodiment of FIG. 1, the shaft splined portion 24 extends from the flange portion 22 and terminates at a free end 112 axially inward from the body end wall 19 at the body second end 18. In addition to the sleeve portion 102 that performs the conversion of linear-to-rotary motion, the piston sleeve 100 includes a piston formed from an annular piston portion 114 and a circular endwall piston portion 116. The annular piston portion 114 is positioned at an end of the piston sleeve 100 toward the body first end 16. The endwall piston portion 116 is positioned at an end of the piston sleeve 100 toward the body second end 18 axially outward of the free end 112 of the shaft splined portion 24. The endwall piston portion 116 closes the end of the sleeve portion 102 into which the shaft splined portion 24 extends. The piston has a first side 118 facing axially inward toward the body first end 16, and a second side 120 facing axially outward toward the body second end 18.

The annular piston portion 114 carries a sleeve bearing 122 which bears against a smooth-walled interior surface portion 124 of the body sidewall 14 located between the body first end 16 and the inner helical body splines 106. The smooth-walled interior surface portion 124 has sufficient axial length to accommodate the full axial stroke of the annular piston portion 114 between its end limits of axial reciprocating travel within the body 12. A circumferential seal 126 is carried by the annular piston portion 114 to provide a fluid-tight seal between the annular piston portion and the smooth-walled interior surface piston portion 124. In conventional manner, the piston sleeve 100 is slideably maintained within the body 12 for reciprocal axial movement, and undergoes longitudinal and rotational movement relative the body as pressurized fluid is selectively applied to one side or the other of the piston formed by the annular piston portion 114 and the endwall piston portion 116.

As will be readily understood, reciprocation of the piston sleeve 100 within the body 12 occurs when hydraulic oil, air or any other suitable fluid under pressure selectively is applied to one side or the other of the piston portions 114 and 116. As the piston sleeve 100 linearly reciprocates in an axial direction within the body 12, the outer helical splines 104 of the sleeve portion 102 engage or mesh with the inner helical splines 106 formed on the interior of the body sidewall 14 to cause rotation of the piston sleeve. The linear and rotational movement of the piston sleeve 100 is transmitted through the inner helical splines 108 of the piston sleeve to the outer helical splines 110 of the shaft spline portion 24 to cause the shaft 20 to rotate relative to the body 12. The longitudinal movement of the shaft 20 is restricted by the first and second sets of ball races R1 and R2 previously described, thereby converting all movement of the piston sleeve 100 into rotational movement of the shaft 20 relative to the body 12. Depending on the direction of turn of the various helical splines, the movement of the piston sleeve 100 toward the body first end 16 may produce either clockwise or counterclockwise rotational movement of the shaft 20 relative to the body 12, and the movement of the piston sleeve toward the body second end 18 will produce opposite rotational movement. Depending on the slope and direction of turn of the various helical splines, there may be provided a multiplication of the rotary movement of the shaft 20 relative to the piston sleeve 100.

In the illustrated embodiment of the actuator 10, pressurized fluid is applied to the first side 118 of the piston portions 114 and 116 of the piston sleeve 100 to move the piston sleeve toward the body second end 18 using a first port 130 in an axially outward end face 132 of the shaft flange portion 22. The first port 130 communicates the pressurized fluid through a first fluid conduit 134 extending substantially the full length of the shaft 20 with the piston first side 118. A threaded end plug 136 which carries a seal 137 is threadably received in a threaded end portion **134*a* of the first fluid conduit 134 toward the body second end 18. As will be described below, the pressurized fluid applied to the first port 130 is delivered by the first fluid conduit 134 to the piston first side 118 of the piston portions 114 and 116 through a main laterally inward-oriented orifice 138 and a smaller-diameter orifice 140 formed in the end plug 136**. The main orifice is laterally inward-oriented.

Pressurized fluid is applied to the second side 120 of the piston portions 114 and 116 of the piston sleeve 100 to move the piston sleeve toward the body first end 16 using a second port 142 in the end face 132 of the shaft flange portion 22. The second port 142 communicates the pressurized fluid through a second conduit 144 extending the length of the shaft flange portion 22 with an elongated, cylindrical central aperture 146 extending coaxially within the shaft along the length of the shaft splined portion 24. The shaft central aperture 146 has an opening 148 at the free end 112 of the shaft splined portion 24. A fluid transfer stem or tube 150 is carried by the endwall piston portion 116 as the piston sleeve 100 rotates and moves axially within the body 12. The pressurized fluid enters a central fluid conduit 152 of the transfer tube 150 through four orthogonal oriented, transverse main orifices 154 at an end of the transfer tube 150 toward the body first end 16, and a reduced-diameter orifice 156 oriented coaxial with the transfer tube and forming an opening in a free end 158 of the transfer tube toward the body first end 16. The pressurized fluid exits the transfer tube through an end opening 160 toward the body second end 18 which is in fluid communication with the second side 120 of the piston.

The transfer tube 150 has a head portion 162 received in a central aperture 164 of the endwall piston portion 116. The central aperture 164 has a circumferential shoulder 166 which limits axial movement of the transfer tube 150 relative to the piston sleeve 100 toward the body first end 16. A retainer clip 168 is spaced away from the shoulder 166 by sufficient axial distance to securely hold the head portion 162 of the transfer tube 150 therebetween in alignment with the longitudinal axis A and prevent axial movement of the transfer tube relative to the piston sleeve. A seal 170 is disposed between the head portion 162 of the transfer tube 150 and the sidewall of the central aperture 164 of the endwall piston portion 116 to provide a fluid-tight seal therebetween. A seal 172 is disposed in a circumferential groove in the sidewall of the shaft central aperture 164, at a position axially away from the free end 112 of the shaft splined portion 24 toward the body first end 16, to provide a fluid-tight seal between the transfer tube 150 and the sidewall of the shaft central aperture. With the foregoing arrangement, the transfer tube 150 is held in coaxial alignment with the body 12 and the shaft 20 as the piston sleeve 100 reciprocates within the body.

The transfer tube 150 extends from the endwall piston portion 116 toward the body first end 16 and extends through the shaft free end opening 148 in the shaft free end 112 and into the shaft central aperture 146 for reciprocal longitudinal movement therewithin as the piston sleeve 100 reciprocates within the body 12. The pressurized fluid in the shaft central aperture 146 communicates with the central fluid conduit 152 of the transfer tube 150.

It is noted that since the shaft 20 is held stationary with respect to the support frame 40 and the mounting plate 38 in the embodiment of FIG. 1, conventional fluid hoses (not shown) may be simply connected to the first and second ports 130 and 142.

As will now be described, the actuator 10 is provided with a means for providing a cushioned stop for the piston sleeve 100 when the piston sleeve approaches either of its end limits of travel toward the body first and second end 16 and 18. Similarly, when the piston sleeve 100 starts from a location toward either end limit of travel, a slow and smooth start of movement is also provided.

Upon the application of pressurized fluid to the first port 130, the pressurized fluid is applied via the first fluid conduit 134 and the orifices 138 and 140 to the first side 118 of the piston portions 114 and 116 to move the piston sleeve 100 toward the body second end 18. When the piston sleeve 100 is starting from the position shown in FIG. 1 at its end limit of travel toward the body first end 16 with pressurized fluid being applied to the first port 130, a lengthwise portion 174 of the transfer tube 150 is snugly fit within the sidewall of the shaft free end opening 148, thus substantially blocking fluid flow through the main orifice 138 of the first fluid conduit 134 until the piston sleeve 100 has moved toward the body second end 18 carrying the transfer tube 150 therewith sufficient to move a reduced-diameter lengthwise portion 176 of the transfer tube to within the shaft free end opening 148. Until this occurs, the pressurized fluid in the first fluid conduit 134 is applied to the first side 118 of the piston portions 114 and 116 only through the smaller-diameter orifice 140 to produce a slow start-up movement for the piston sleeve 100. Once the piston sleeve 100 has moved toward the body second end 18 sufficiently to position the reduced-diameter transfer tube portion 176 within the shaft free end opening 148, pressurized fluid will flow through the main orifice 138 and around the reduced-diameter transfer tube portion 176 to the first side 118 of the piston portions, thus producing accelerated axial movement of the piston sleeve.

It should be kept in mind that as the piston sleeve 100 is moving toward the body second end 18, the fluid that resides within the body 12 on the second side 120 of the piston portions 114 and 116 must be exhausted for there to be any movement of the piston sleeve if the fluid being used is substantially incompressible, such as is hydraulic oil. As the piston sleeve 100 moves toward the body second end 18, the fluid is exhausted through the transfer tube 150 to the shaft central aperture 146 and the second fluid conduit 144 for exhaust through the second port 142.

However, as the piston sleeve 100 approaches its end limit of travel toward the body second end 18, the transverse main orifices 154 of the transfer tube 150 will encounter a reduced-diameter sidewall portion 180 of the shaft central aperture 146 within which the reduced-diameter transfer tube portion 176 snugly fits. This reduced-diameter sidewall portion 180 is sized to substantially block fluid flow through the four transverse main orifices 154, thus slowing down the movement of the piston sleeve 100 toward the body second end 18 as the piston sleeve 100 approaches its end limit of travel. The exhaust flow will still continue through the smaller-diameter central orifice 156, but the travel speed of the piston sleeve 100 will be reduced. Hence, when the piston sleeve 100 reaches its end limit of travel, the stop will be cushioned. As noted above, the actuator 10 of FIG. 1 provides for a slow start of the piston sleeve 100 when commencing its stroke from its end limit of travel toward the body first end 16 toward the body second end 18, and a slow stopping of the piston sleeve as it reaches its end limit of travel toward the body second end, to produce a much smoother starting and stopping actuator action.

Similarly, the same advantages are provided when the piston sleeve 100 commences a stroke from its end limit of travel toward the body second end 18 toward the body first end 16. In this situation, the pressurized fluid is applied to the second port 142, but as noted above, when at its end limit of travel toward the body second end, the four transverse main orifices 154 of the transfer tube 150 are blocked by the reduced-diameter sidewall portion 180 of the shaft central aperture 146. Hence, the pressurized fluid applied to the second side 120 of the piston portions 114 and 116 passes only through the smaller-diameter orifice 156 until the piston sleeve 100 has moved toward the body first end 16 carrying the transfer tube 150 therewith, sufficient to move the transverse main orifices 154 clear of the reduced-diameter sidewall portion 180 of the shaft central aperture 146. When this occurs, the axial movement of the piston sleeve 100 will be accelerated.

When the piston sleeve 100 is moving toward the body first end 16, the fluid to the first side 118 of the piston portions 114 and 116 is exhausted through the orifices 138 and 140 of the first fluid conduit 134 to the first port 130. When the piston sleeve 100, carrying the transfer tube 142 therewith, approaches its end limit of travel toward the body first end 16, the portion 174 of the transfer tube 150 again reaches the shaft free end opening 148 and the exhaust flow of fluid through the main orifice 138 is substantially blocked. The exhaust fluid still will flow through the smaller-diameter orifice 140, but the travel speed of the piston sleeve 100 will be reduced. Thus, the piston sleeve 100 will have a slow start when commencing its stroke from its end limit of travel toward the body second end 18 toward the body first end 16, and a slow stopping as it reaches its end limit of travel toward the body first end, to produce a much smoother starting and stopping actuator action.

A tapered shoulder 182 between the portion 174 of the transfer tube 150 and the reduced-diameter transfer tube portion 176 governs the quickness of the change in speed that will be encountered as the shoulder moves by the shaft free end opening 148. A gradual tapering will produce a slower transition in speed as the shoulder passes by the shaft free end opening. A similar transition occurs with the transverse main orifices 154 of the transfer tube 150 since they will be progressively blocked as they pass by the reduced-diameter sidewall portion 180.

It is noted that an actuator using the bearing arrangement of the present invention may be constructed using a transfer tube similar to the transfer tube 150, except that it is carried by the shaft 20 instead of the piston sleeve 100, with the piston sleeve reciprocating relative to the transfer tube, such as will be described below for the embodiment of FIG. 3. With such an arrangement, the orifices described above which provide for the slow start and cushioned stop of the piston sleeve may also be provided. It is further noted that the bearing arrangement described above may be used with an actuator having its housing attached to a support frame so that the rotary drive is provided by the shaft to the rotatable external device. In this case, since the housing would not be rotating relative to the support frame, fluid hoses could be connected directly to ports in the body sidewall to provide pressurized fluid to the piston sleeve and it would not be necessary to use a transfer tube.

In the embodiment of FIG. 1, the first set of ball races R1 formed by the flange ball race 32 and the bearing carrier ball race 78, and the second set of ball races formed by the mounting plate ball race 52 and the bearing carrier ball race 82, are formed with opposing bearing shoulders. The bearing shoulder of the bearing carrier ball race 78 faces generally inward toward the body second end 18 and the bearing shoulder of the flange portion ball race 32 faces generally outward to provide center ball contact points for the first set of races R1 which are diametrically opposed when the ball bearings 80 are therebetween, as shown by a ball contact line "B". Likewise, the bearing shoulder of the bearing carrier ball race 82 faces generally outward away from the body second end 18 and the bearing shoulder of the mounting plate ball race 52 faces generally inward toward the body second end 18 to provide center ball contact points for the second set of races, which are diametrically opposed when the ball bearings 84 are therebetween, as shown by a ball contact line "C". The ball contact lines B and C are established by a straight line drawn between the center ball contact points for each of the ball races 32 and 78, and each of the ball races 52 and 82, respectively. The ball contact lines B and C are drawn inward toward the longitudinal rotational axis A of the body 12 and shaft 20. As can be seen, the ball contact lines B and C intersect the longitudinal axis A at points spaced farther apart than the actual axial spacing between the ball bearings 80 and 84 of the first and second sets of races R1 and R2. The distance between where the ball contact lines B and C intersect the longitudinal axis A represents an effective bearing spacing which is substantially larger than the actual bearing spacing of the first and second sets of races, thereby producing an increased effective bearing spacing which increases the ability of the actuator 10 to carry large loads. Also, the radial position of the first and second sets of races R1 and R2 from the longitudinal axis A (i.e., the pitch diameter of the races) is larger than with conventional shaft bearings where the shaft-supporting bearings are located within the body, hence further increasing the load-carrying ability of the actuator 10.

It is also noted that with the actuator 10, the free end 112 of the splined shaft portion 24 is not radially restrained by any bearing, but rather loosely received within the splined sleeve portion 102 of the piston sleeve 100. This free-floating shaft design allows substantial rocking movement of the shaft within the body 12 without binding of the splines as can occur when the shaft is held fixed in place at both of its axial ends by bearings. Unlike with prior art actuators, the bearing design of the present invention results in bending moments being transmitted to the body 12 through the bearing carrier 54 and not to the shaft 20.

The result is an actuator that is able to handle large radial and axial thrust loads, and large moment loads without binding. This is achieved with a very compact, lightweight and economical actuator construction.

Figure 3:
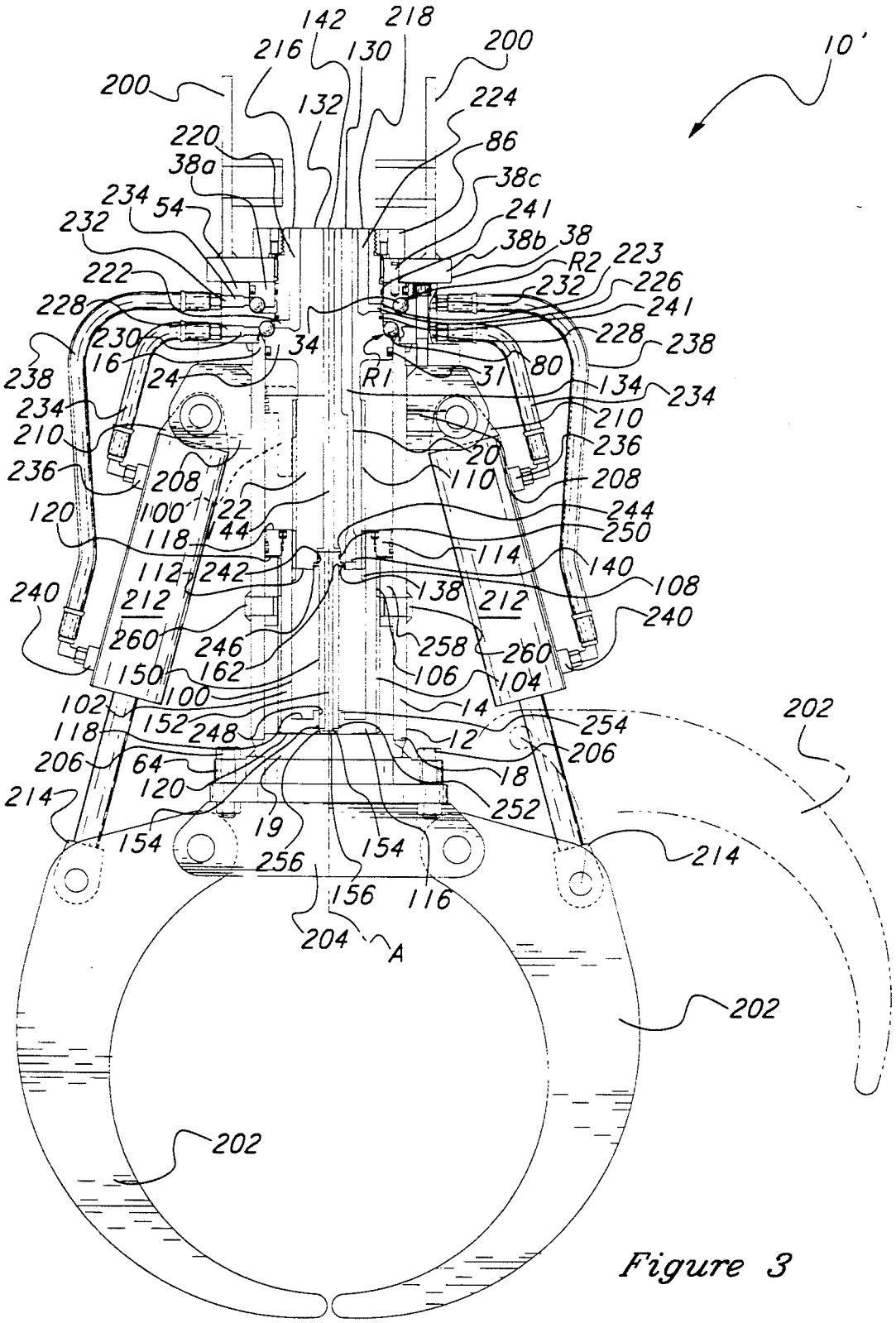
FIG. 3 is a side elevational, sectional view of an alternative embodiment of the actuator of FIG. 1.

An alternative embodiment of the invention is shown in FIG. 3. For ease of understanding, the components of this alternative embodiment will be similarly numbered with those of the first embodiment when of a similar construction. Further, only the significant differences in construction will be described in detail.

In FIG. 3, an actuator 10' is shown having a boom arm mounting bracket 200 welded to the mounting plate 38 for attachment of the actuator to the end of a boom arm (not shown) of a vehicle (not shown) which carries the actuator. As before, the shaft 20 is held stationary relative to the mounting plate 38, and hence relative to the boom arm, and the body 12 provides the rotational drive. In the embodiment of actuator 10' illustrated, the body mounting plate 64 is welded to the body second end 18 and a pair of grapple arms 202 used to handle logs are pivotally attached to a base plate 204 which is bolted to the body mounting plate 64 using a plurality of bolts 206.

The body 12 has two clevises 208 welded thereto at a position toward the body first end 16. Each clevis 208 projects outwardly from an opposite side of the body 12, and each has a first end 210 of one of a pair of hydraulically operated cylinders 212 pivotally attached thereto. Each of the grapple arms 202 has a second extendible end 214 of one of the cylinders 212 pivotally attached thereto. The grapple arms 202 are oriented so that extension and retraction of the cylinders 212 cause the grapple arms to pivot between a closed position as shown in FIG. 3 for carrying a load, and an open position for release of the load (only one arm is shown in the open position in phantom line in FIG. 3). It should be understood that while the actuator 10' is described with the pair of grapple arms 202 being carried by the actuator 10', the actuator has many other uses.

With the actuator 10' shown in FIG. 3, the bearing carrier 54 serves not only to provide the bearing carrier ball races 78 and 82, but also as a fluid coupling or gland to provide hydraulic fluid to the cylinders 212 while at the same time providing lubrication for the ball bearings 80 and 84 seated in the first and second sets of races. Pressurized fluid is selectively applied via the bearing carrier 54 to the cylinders 212 for operation of the grapple arms 202, as will now be described.

The end face 132 of the shaft flange portion 22 is provided with third and fourth port 216 and 218, respectively. The third port 216 communicates the pressurized fluid applied thereto through a third fluid conduit 220 extending within the shaft flange portion 22 with an orifice 222 in a circumferential sidewall 223 of the bearing carrier 54 which is positioned to communicate with the first set of races Rl formed by the flange portion ball race 32 and the bearing carrier ball race 78. Similarly, the fourth port 218 communicates the pressurized fluid applied thereto through a fourth fluid conduit 224 extending through the shaft flange portion 22 with an orifice 226 in the bearing carrier sidewall 223 which is positioned to communicate with the second set of races R2 formed by the mounting plate ball race 52 and the bearing carrier ball race 82. The orifices 222 and 226 remain in fluid communication with the first and second sets of races, respectively, as the bearing carrier 54 rotates relative to the shaft 20.

In the embodiment of FIG. 3, the mounting plate 38 has a two-piece construction with a bearing ring portion **38*a* and an attachment plate portion 38*b* held together by a fasteners 38*c*. The mounting plate ball race 52 is formed on the bearing ring portion 38*a***.

The bearing carrier 54 is provided with a first pair of ports 228 located on opposites sides thereof. Each of the ports 228 is in fluid communication with the first set of ball races R1 through one of a pair of first bearing carrier fluid conduits 230 (only one fluid conduit 230 being shown in FIG. 3). The bearing carrier 54 is also provided with a second pair of ports 232 located on opposite sides thereof. Each of the ports 232 is in fluid communication with the second set of ball races R2 through one of a pair of second bearing carrier fluid conduits 234 (only one fluid conduit 234 being shown in FIG. 3). The bearing carrier 54 in the embodiment of FIG. 3 serves the additional function of a fluid gland to communicate pressurized fluid with a pair of flexible hydraulic hoses 234 which supply pressurized fluid to the cylinders 212 to extend them and thereby pivot the grapple arms 202 toward the closed position, and another pair of flexible hydraulic hoses 238 which supply pressurized fluid to the cylinders 212 to retract them and thereby pivot the grapple arms 202 toward the open position. Each of the hoses 234 has one end connected to one of the ports 228 in the bearing carrier 54, and another end connected to an extension port 236 of one of the cylinders 212. Each of the hoses 238 has one end connected to one of the ports 232 in the bearing carrier 54, and another end connected to a retraction port 240 of one of the cylinders 212.

Since both of the hoses 234 are in fluid communication with the third fluid port 216, and both of the hoses 238 are in fluid communication with the fourth fluid port 218, the application of pressurized fluid to either of the third or fourth ports will cause both of the cylinders 212 to extend or retract substantially simultaneously, thus causing both of the grapple arms 202 to close and open in unison. Of course, if it is desired to use another tool which requires only one movable tool portion and hence only a single hydraulic cylinder, then only two hoses would be required for the operation of the tool. While the embodiment of FIG. 3 is described for operation with a tool, the actuator 10' is useful for a variety of applications, as is the actuator 10 of FIG. 1.

Since the body 12 to which the grapple arms 202 and the cylinders 212 are attached is rotated as a unit relative to the shaft 20, the hoses 234 and 238 will rotate with the body and hence undergo no twisting or pulling during operation of the actuator 10', even though the body is rotated through its full extent of clockwise and counterclockwise rotation. Further, the actuator 10' can be constructed using relatively short lengths of hoses without the usual large hose loops required to provide for full rotation, which make prior art devices susceptible to hose twisting and entanglement or snagging on objects when in transit and during operation.

In addition to the seal 31 previously described between the shaft flange portion 22 and the body 12, seals 241 are provided between the bearing carrier 54 and the body, between the bearing carrier and the shaft flange portion, between the bearing carrier and the mounting plate bearing ring portion 38*a*, and between the mounting plate bearing ring portion and the shaft flange portion to prevent the leakage of pressurized fluid from and between the first and second sets of races R1 and R2 as the actuator 10' operates.

When applying pressurized fluid to the third and fourth ports 216 and 218 in the end face 132 of the shaft flange portion 22 so as to operate the cylinders 212, the pressurized fluid is passing around the ball bearings 80 and 84 seated in the first and second sets of ball races R1 and R2 and lubricating the ball bearings and ball races. This eliminates the need for separate grease fittings to keep the first and second ball races lubricated, and also eliminates the need for manual lubrication since the ball races and ball bearings are constantly lubricated by the fluid applied to the cylinders 212.

The first fluid conduit 134 utilizes the orifices 138 and 140 to control the flow of fluid on starting and stopping of the piston sleeve 100; however, the main orifice 138 terminates in the sidewall of the end recess, to an axial side of the seal 250 toward the body second end 18, in a position to have the flow of fluid therethrough blocked by an axially inward-projecting collar portion 254 of the endwall piston portion 116 when the piston sleeve 100 is near its end limit of travel toward the body first end 16. When in such position, the flow of fluid through the smaller-diameter orifice 140 will continue.

The second fluid conduit 144, while still providing fluid communication through the transfer tube 150 to the second side 120 of the piston portions 114 and 116, the transfer tube is carried by the shaft 20, not the piston sleeve 100. In this embodiment, the head portion 162 of the transfer tube 150 is received in an end recess 242 of the shaft splined portion 24 at the free end 112 of the shaft splined portion and held securely between a shoulder 244 of the end recess 242 and a retainer clip 246. The transfer tube 150 projects from the free end 112 of the shaft splined portion 24 toward the body second 18 and passes through a central aperture 248 in the endwall piston portion 116 of the piston sleeve 100. A seal 250 is disposed between the head portion 162 of the transfer tube 150 and the sidewall of the end recess 242 to provide a fluid-tight seal therebetween. A seal 252 is carried in a circumferential groove formed about the central aperture 248 of the endwall piston portion 116 to provide a fluid-tight seal between the endwall piston portion and the transfer tube 150.

The actuator 10' is also provided with a slow start and cushioned stop arrangement similar to the embodiment of FIG. 1. The transfer tube 150 utilizes the orifices 154 and 156 to control the flow of fluid on starting and stopping of the piston sleeve 100; however, the transverse main orifices 154 are positioned to have the flow of fluid therethrough blocked by an interior sidewall portion 256 of the piston central aperture 248, to an axial side of the seal 252 toward the body second end 18, when the piston sleeve 100 is near its end limit of travel toward the body second end 18. When in such position, the flow of fluid through the smaller-diameter orifice 156 will continue. Even if the orifices were not provided to accomplish the slow start and cushioned stop feature, use of the transfer tube 150 would still provide a convenient means for communicating pressurized fluid to the second side 120 of the piston portions 114 and 116.

In the embodiment of FIG. 3, the shaft 20 is held stationary by the mounting plate 38 relative to the boom to which it is connected and which typically carries the supply of hydraulic fluid. As such, the transfer tube 150 in this embodiment is also held stationary with respect to the boom, and the piston sleeve 100 rotates and moves linearly with respect to the transfer tube.

The actuator 10' has the inner helical splines 106 are formed on a ring gear 258 which is joined to the body 12 by a plurality of pins 260, rather than being formed on the interior of the body sidewall 14.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered rotary actuator to produce relative rotational movement between first and second members, comprising:

a tubular body having a longitudinal axis, and first and second ends, said body being adapted for coupling to the first member to transfer rotational force thereto;

a drive member having a flange positioned at and extending axially outward of said body beyond said body first end, and a shaft extending longitudinally and generally coaxially within said body toward said body second end, said flange being fixedly attached to said shaft and extending generally radially outward beyond said shaft, said flange having first and second end portions with said flange second end portion being adjacent to said body first end and said flange first end portion being axially outward of said flange second end portion and said body first end, said flange also having an intermediate portion between said flange first and second end portions and axially outward of said body first end, said flange second end portion having an axially outward-facing circular ball race formed thereon, said flange first end portion being threaded and said flange intermediate portion having straight splines formed thereon;

a mounting member adapted for coupling to the second member to transfer rotational force thereto, said mounting member having an aperture with said flange intermediate portion extending therethrough and straight splines meshing with said straight splines of said flange intermediate portion to permit adjusting longitudinal movement of said mounting member relative to said flange, said mounting member having an axially inward-facing circular ball race formed thereon about said mounting member aperture;

an adjustable retaining nut threadably mounted on said threaded flange first end portion axially outward of said mounting member and engaging said mounting member, said retaining nut being adjustably rotatable on said threaded flange first end portion;

an annular bearing carrier mounted coaxially with and fixedly attached to said body at said body first end axially outward of said body first end, said carrier having a central aperture with said flange extending therethrough, said carrier further having an axially inward-facing circular ball race formed thereon about said carrier aperture and confronting and corresponding to said flange second end portion ball race to form a first set of races extending circumferentially about said flange at said body first end to rotatably support said drive member and limit outward longitudinal movement of said drive member, and an axially outward-facing circular ball race formed thereon about said carrier aperture and confronting and corresponding to said mounting member ball race to form a second set of races extending circumferentially about said flange axially outward of said first set of races to rotatably support said drive member and limit inward longitudinal movement of said drive member, said first and second sets of races providing the full rotational support for said drive member relative to said body at a location at or outward of said body first end, with adjustable rotation of said retaining nut on said threaded flange first end portion to longitudinally move said retaining nut inward preloading said first and second sets of races;

one or more ball bearings seated in each of said first and second sets of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft to translate longitudinal movement of said piston toward one of said body first or second ends into clockwise relative rotational movement between said drive member and said body, and longitudinal movement of said piston toward the other of said body first or second ends into counterclockwise relative rotational movement between said drive member and said body, whereby relative rotational movement between the first and second members results.

2. The actuator of claim 1 wherein said flange second end portion ball race is cut directly into said drive member flange rather than formed on an annular ball race insert carried by said flange second end portion.

3. A fluid-powered rotary actuator to produce relative rotational movement between a rotatable first member and a second member, comprising:

a tubular body having a longitudinal axis, and first and second ends, said body being adapted for coupling to the first member to transfer rotational force thereto;

a piston having a first side toward said body first end and a second side toward said body second end, said piston being mounted for reciprocal longitudinal movement within said body in response to selective application of pressurized fluid thereto;

a drive member having a flange positioned at and extending axially outward of said body beyond said body first end, and a stub shaft extending longitudinally and generally coaxially within said body toward said body second end and terminating in a free end positioned between said piston first side and said body first end, said flange being fixedly attached to said shaft and extending generally radially outward beyond said shaft, said flange having first and second end portions with said flange second end portion being adjacent to said body first end and said flange first end portion being axially outward of said flange second end portion and said body first end, said flange also having an intermediate portion between said flange first and second end portions and axially outward of said body first end, said flange second end portion having an axially outward-facing circular ball race formed thereon, said flange first end portion being threaded and said flange intermediate portion having straight splines formed thereon, said drive member having an elongated central aperture extending coaxially with said drive member and said piston, said central aperture having an opening at said shaft free end, said drive member further having a first fluid conduit forced therein to provide fluid communication between said piston first side and a first port formed in said drive member at a location exterior of said body, and a second fluid conduit formed therein to provide fluid communication between said central aperture and a second port formed in said drive member at a location exterior of said body;

a fluid transfer tube carried by said piston as said piston moves within said body, said tube extending through said shaft free end opening and into said drive member central aperture for reciprocal longitudinal movement therewithin as said piston longitudinally reciprocates within said body, said tube having a fluid conduit with a first opening in a free end portion of said tube positioned within said central aperture and a second opening at a position in fluid communication with said piston second side to provide fluid communication between said second port and said piston second side, the selective application of pressurized fluid to said first port in said drive member applying pressurized fluid to said piston first side to move said piston toward said body second end, and the selective application of pressurized fluid to said second port in said drive member applying pressurized fluid to said piston second side to move said piston toward said body first end;

a mounting member adapted for coupling to the stationary second member to transfer rotational force thereto, said mounting member having an aperture with said flange intermediate portion extending therethrough and straight splines meshing with said straight splines of said flange intermediate portion to permit adjusting longitudinal movement of said mounting member relative to said flange while holding said flange stationary against rotation relative to the second member, said mounting member having an axially inward-facing circular ball race formed thereon about said mounting member aperture;

an adjustable retaining nut threadably mounted on said threaded flange first end portion axially outward of said mounting member and engaging said mounting member, said retaining nut being adjustably rotatable on said threaded flange first end portion;

an annular bearing carrier mounted coaxially with and fixedly attached to said body at said body first end axially outward of said body first end, said carrier having a central aperture with said flange extending therethrough, said carrier further having an axially inward-facing circular ball race formed thereon about said carrier aperture and confronting and corresponding to said flange second end portion ball race to form a first set of races extending circumferentially about said flange at said body first end to rotatably support said drive member and limit outward longitudinal movement of said drive member, and an axially outward-facing circular ball race formed thereon about said carrier aperture and confronting and corresponding to said mounting member ball race to form a second set of races extending circumferentially about said flange axially outward of said first set of races to rotatably support said drive member and limit inward longitudinal movement of said drive member, said first and second sets of races providing the full rotational support for said drive member relative to said body at a location at or outward of said body first end, with adjustable rotation of said retaining nut on said threaded flange first end portion to longitudinally move said retaining nut inward preloading said first and second sets of races;

one or more ball bearings seated in each of said first and second sets of races; and a torque-transmitting member mounted for reciprocal longitudinal movement within said body, said torque-transmitting member engaging said body and said shaft to translate longitudinal movement of said piston toward one of said body first or second ends into clockwise relative rotational movement of said body relative to said drive member, and longitudinal movement of said piston toward the other of said body first or second ends into counterclockwise rotational movement of said body relative to said drive member, whereby rotational movement of the first member relative to the secondary member results using pressurized fluid connectors attached to said first and second ports of said drive member which is held stationary by said mounting member against rotation relative to the second member.

4. The actuator of claim 3 wherein said flange second end portion ball race is cut directly into said drive member flange rather than formed on an annular ball race insert carried by said flange second end portion.

5. The actuator of claim 3 wherein as pressurized fluid is applied to said first port to move said piston toward said body second end, fluid to said piston second side is exhausted via said tube, said central aperture and said drive member second fluid conduit to said second port, and wherein said tube first opening includes a first orifice in a sidewall of said tube toward an end thereof away from said piston, and said central aperture has a reduced-diameter interior sidewall portion toward said shaft free end, said reduced diameter sidewall portion being sized and positioned such that as said piston approaches an end limit of travel toward said body second end carrying said tube therewith, said first orifices reach said reduced diameter sidewall portion and said reduced-diameter sidewall portion at least partially blocks the exhaust flow of fluid from said piston second side through said first orifice to slow the travel of said piston as said piston reaches its end limit of travel toward said body second end, whereby as said piston reaches said end limit a cushioned stop is experienced.

6. The actuator of claim 3 wherein as pressurized fluid is applied to said first port to move said piston toward said body second end, fluid to said piston second side is exhausted via said tube, said central aperture and said drive member second fluid conduit to said second port, and wherein said tube first opening includes first and second orifices, said first orifice being positioned in a sidewall of said tube toward an end thereof away from said piston, and said central aperture has a reduced-diameter interior sidewall portion toward said shaft free end, said reduced-diameter sidewall portion being sized and positioned such that as said piston approaches an end limit of travel toward said body second end carrying said tube therewith, said first orifices reaches said reduced-diameter sidewall portion and said reduced-diameter sidewall portion substantially blocks the exhaust flow of fluid from said piston second side through said first orifice while permitting continued exhaust flow through said second orifices to slow the travel of said piston as said piston reaches its end limit of travel toward said body second end, whereby as said piston reaches said end limit a cushioned stop is experienced.

7. The actuator of claim 3 wherein as pressurized fluid is applied to said second port to move said piston toward said body first end, fluid to said piston first side is exhausted via said drive member first fluid conduit to said first port, and wherein said drive member first fluid conduit includes a first orifice in a sidewall of said central aperture at an end portion thereof toward said shaft free end opening, and the actuator includes a seal located within said central aperture and axially positioned between said first orifice and an end limit of travel position of said tube first opening reached when said piston reaches an end limit of travel toward said body second end, said seal providing a fluid-tight seal between said drive member and said tube, said tube having an enlarged-diameter exterior sidewall portion toward said piston, said enlarged-diameter sidewall portion being sized and positioned such that as said piston approaches an end limit of travel toward said body first end carrying said tube therewith, said enlarged diameter sidewall portion reaches said first orifice and said enlarged-diameter sidewall portion at least partially blocks the exhaust flow of fluid from said piston first side through said first orifice to slow the travel of said piston as said piston reaches its end limit of travel toward said body first end, whereby as said piston reaches said end limit, a cushioned stop is experienced.

8. The actuator of claim 3 wherein as fluid is applied to said second port to move said piston toward said body first end, fluid to said piston first side is exhausted via said drive member first fluid conduit to said first port, and wherein said drive member first fluid conduit includes first and second orifices, said first orifice being positioned in a sidewall of said central aperture at an end portion thereof toward said shaft free end opening, and the actuator includes a seal located within said central aperture and axially positioned between said first orifices and an end limit of travel position of said tube first opening reached when said piston reaches an end limit of travel toward said body second end, said seal providing a fluid-tight seal between said drive member and said tube, said tube having an enlarged-diameter exterior sidewall portion toward said piston, said enlarged-diameter sidewall portion being sized and positioned such that as said piston approaches an end limit of travel toward said body first end carrying said tube therewith, said enlarged-diameter sidewall portion reaches said first orifice and said enlarged-diameter sidewall portion substantially blocks the exhaust flow of fluid from said piston first side through said first orifice while permitting continued exhaust flow through said second orifice to slow the travel of said piston as said piston reaches its end limit of travel toward said body first end, whereby as said piston reaches said end limit a cushioned stop is experienced.

9. The actuator of claim 8 wherein as pressurized fluid is applied to said first port to move said piston toward said body second end, fluid to said piston second side is exhausted via said tube, said central aperture and said drive member second fluid conduit to said second port, and wherein said tube first opening includes third and fourth orifices, said third orifice being positioned in a sidewall of said tube toward an end thereof away from said piston, and said central aperture has a reduced-diameter interior sidewall portion toward said shaft free end, said reduced-diameter sidewall portion being sized and positioned such that as said piston approaches an end limit of travel toward said body second end carrying said tube therewith, said first orifice reaches said reduced-diameter sidewall portion and said reduced-diameter sidewall portion substantially blocks the exhaust flow of fluid from said piston second side through said third orifice while permitting continued exhaust flow through said fourth orifice to slow the travel of said piston as said piston reaches its end limit of travel toward said body second end, whereby as said piston reaches said end limit a cushioned stop is experienced.

10. A fluid-powered rotary actuator to produce relative rotational movement between first and second members, comprising:

a body having a longitudinal axis, and first and second ends, said body being adapted for coupling to the first member to transfer rotational force thereto;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being adjacent to said body first end and said first end portion of said shaft first portion being axially outward of said body first end, said shaft first portion also having an intermediate portion between said first and second end portions of said shaft first portion and axially outward of said body first end, said second end portion of said shaft first portion having an axially outward-facing bearing race formed thereon extending circumferentially thereabout, said first end portion of said shaft first portion being threaded and said intermediate portion of said shaft first portion having at least one first torque-transmitting element;

a mounting member adapted for coupling to the second member to transfer rotational force thereto, said mounting member having an aperture with said intermediate portion of said shaft first portion extending therethrough and at least one second torque-transmitting element engaging said first torque-transmitting element of said intermediate portion to transmit rotational force therebetween while permitting adjusting longitudinal movement of said mounting member relative to said shaft first portion, said mounting member having an axially inward-facing bearing race formed thereon about said mounting member aperture;

an adjustable retaining nut threadably mounted on said threaded first end portion of said shaft first portion axially outward of said mounting member and engaging said mounting member, said retaining nut being adjustably rotatable on said threaded first end portion;

an annular bearing carrier mounted coaxially with and fixedly attached to said body at said body first end axially outward of said body first end, said carrier having a central aperture with said shaft first portion extending therethrough for rotation of said carrier relative to said shaft first portion, said carrier further having an axially inward-facing bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and an axially outward-facing bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable rotation of said retaining nut on said threaded first end portion of said shaft first portion to longitudinally move said retaining nut inward preloading said first and second sets of races;

one or more bearings seated in each of said first and second sets of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between the first and second members results.

11. A fluid-powered rotary actuator to produce relative rotational movement between a rotatable first member and a second member, comprising:

a body having a longitudinal axis, and first and second ends, said body being adapted for coupling to the first member to transfer rotational force thereto;

a piston having a first side toward said body first end and a second side toward said body second end, said piston being mounted for reciprocal longitudinal movement within said body in response to selective application of pressurized fluid thereto;

a shaft having a first portion positioned at and extending axially outward of said body beyond said body first end, and a stub shaft second portion extending longitudinally and generally coaxially within said body toward said body second end and terminating in a free end positioned between said piston first side and said body first end said shaft first portion having first and second end portions with said second end portion being adjacent to said body first end and said first end portion being axially outward of said second end portion and said body first end, said shaft first portion also having an intermediate portion between said first and second end portions and axially outward of said body first end, said second end portion having an axially outward-facing bearing race formed thereon extending circumferentially thereabout, said first end portion being threaded and said intermediate portion having at least one first torque-transmitting element, said shaft having an elongated central aperture extending coaxially with said shaft and said piston, said central aperture having an opening at said shaft free end, said shaft further having a first fluid conduit formed therein to provide fluid communication between said piston first side and a first port formed in said shaft at a location exterior of said body, and a second fluid conduit formed therein to provide fluid communication between said central aperture and a second port formed in said shaft at a location exterior of said body;

a fluid transfer tube carried by said piston as said piston moves within said body, said tube extending through said shaft free end opening and into said shaft central aperture for reciprocal longitudinal movement therewithin as said piston longitudinally reciprocates within said body, said tube having a fluid conduit with a first opening in a free end portion of said tube positioned within said central aperture and a second opening at a position in fluid communication with said piston second side to provide fluid communication between said second port and said piston second side, the selective application of pressurized fluid to said first port applying pressurized fluid to said piston first side to move said piston toward said body second end, and the selective application of pressurized fluid to said second port applying pressurized fluid to said piston second side to move said piston toward said body first end;

a mounting member adapted for coupling to the second member to transfer rotational force thereto, said mounting member having an aperture with said intermediate portion extending therethrough and at least one second torque-transmitting element engaging said first torque-transmitting element of said intermediate portion to transmit rotational force therebetween and hold said shaft first portion against rotation relative to the second member, while permitting adjusting longitudinal movement of said mounting member relative to said shaft first portion, said mounting member having an axially inward-facing bearing race formed thereon about said mounting member aperture;

an adjustable retaining nut threadably mounted on said threaded first end portion axially outward of said mounting member and engaging said mounting member, said retaining nut being adjustably rotatable on said threaded first end portion;

an annular bearing carrier mounted coaxially with and fixedly attached to said body at said body first end axially outward of said body first end, said carrier having a central aperture with said flange extending therethrough, said carrier further having an axially inward-facing bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and an axially outward-facing bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable rotation of said retaining nut on said threaded first end portion to longitudinally move said retaining nut inward preloading said first and second sets of races;

one or more bearings seated in each of said first and second sets of races; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement of said body relative to said shaft, and longitudinal movement of said piston toward the other of said body first or second ends into counterclockwise rotational movement of said body relative to said shaft, whereby rotational movement of the first member relative to the secondary member results using pressurized fluid connectors attached to said first and second ports of said shaft which is held stationary by said mounting member against rotation relative to the second member.

12. A fluid-powered rotary actuator to produce relative rotational movement between first and second members, comprising:

a body having a longitudinal axis, and first and second ends, said body being adapted for coupling to the first member to transfer rotational force thereto;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being toward said body first end and said first end portion of said shaft first portion being axially outward of said body first end, said shaft first portion also having an intermediate portion between said first and second end portions of said shaft first portion and axially outward of said body first end, said second end portion of said shaft first portion having a bearing race formed thereon extending circumferentially thereabout, and said intermediate portion of said shaft first portion having at least one first torque-transmitting element;

a mounting member adapted for coupling to the second member to transfer rotational force thereto, said mounting member having an aperture with said intermediate portion of said shaft first portion extending therethrough and at least one second torque-transmitting element engaging said first torque-transmitting element of said intermediate portion to transmit rotational force therebetween while permitting adjusting longitudinal movement of said mounting member relative to said shaft first portion, said mounting member having a bearing race formed thereon about said mounting member aperture;

an adjustable member mounted on said first end portion of said shaft first portion and engaging said mounting member to limit axially outward movement of said mounting member relative to said shaft first portion, said adjustable member being adjustably axially positionable on said first end portion;

an annular bearing carrier mounted coaxially with and fixedly attached to said body at said body first end axially outward of said body first end, said carrier having a central aperture with said shaft first portion extending therethrough, said carrier further having a bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and a bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable axially inward positioning of said adjustable member on said first end portion of said shaft first portion preloading said first and second sets of races;

one or more bearings seated in each of said first and second sets of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between the first and second members results.

13. A fluid-powered rotary actuator to produce relative rotational movement between a rotatable first member and a second member, comprising:

a body having a longitudinal axis, and first and second ends, said body being adapted for coupling to the first member to transfer rotational force thereto;

a piston having a first side toward said body first end and a second side toward said body second end, said piston being mounted for reciprocal longitudinal movement within said body in response to selective application of pressurized fluid thereto;

a shaft having a first portion positioned at and extending axially outward of said body beyond said body first end, and a stub shaft second portion extending longitudinally and generally coaxially within said body toward said body second end and terminating in a free end positioned between said piston first side and said body first end, said shaft first portion having first and second end portions with said second end portion being toward said body first end and said first end portion being axially outward of said second end portion and said body first end, said shaft first portion also having an intermediate portion between said first and second end portions and axially outward of said body first end, said second end portion having a bearing race formed thereon extending circumferentially thereabout, and said intermediate portion having at least one first torque-transmitting element, said shaft further having a first fluid conduit formed therein to provide fluid communication between said piston first side and a first port formed in said shaft at a location exterior of said body, and a second fluid conduit formed therein to provide fluid communication between an opening at said shaft free end of an elongated shaft central aperture and a second port formed in said shaft at a location exterior of said body;

a fluid transfer tube carried by said piston as said piston moves within said body, said tube extending through said shaft free end opening and into said shaft central aperture for reciprocal longitudinal movement therewithin as said piston longitudinally reciprocates within said body, said tube having a fluid conduit with a first opening in a free end portion of said tube positioned within said central aperture and a second opening at a position in fluid communication with said piston second side to provide fluid communication between said second port and said piston second side, the selective application of pressurized fluid to said first port applying pressurized fluid to said piston first side to move said piston toward said body second end, and the selective application of pressurized fluid to said second port applying pressurized fluid to said piston second side to move said piston toward said body first end;

a mounting member adapted for coupling to the second member to transfer rotational force thereto, said mounting member having an aperture with said intermediate portion extending therethrough and at least one second torque-transmitting element engaging said first torque-transmitting element of said intermediate portion to transmit rotational force therebetween and hold said shaft first portion against rotation relative to the second member while permitting adjusting longitudinal movement of said mounting member relative to said shaft first portion, said mounting member having a bearing race formed thereon about said mounting member aperture;

an adjustable member mounted on said first end portion and engaging said mounting member to limit axially outward movement of said mounting member relative to said shaft first portion, said adjustable member being adjustably axially positionable rotatable on said first end portion;

an annular bearing carrier mounted coaxially with and fixedly attached to said body at said body first end axially outward of said body first end, said carrier having a central aperture with said flange extending therethrough, said carrier further having a bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and a bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable axially inward positioning of said adjustable member on said first end portion preloading said first and second sets of races;

one or more bearings seated in each of said first and second sets of races; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement of said body relative to said shaft, and longitudinal movement of said piston toward the other of said body first or second ends into counterclockwise rotational movement of said body relative to said shaft, whereby rotational movement of the first member relative to the secondary member results using pressurized fluid connectors attached to said first and second ports of said shaft which is held by said mounting member against rotation relative to the stationary second member.

14. The actuator of claim 13 wherein said tube first opening includes a first orifice in said tube toward an end thereof away from said piston, and said shaft second portion has a closure portion toward said shaft free end, said shaft closure portion being sized and positioned such that when said piston is in position toward an end limit of travel toward said body second end, said shaft closure portion at least partially blocks the flow of fluid through said first orifice.

15. The actuator of claim 14 wherein said shaft first fluid conduit includes a second orifice toward said shaft free end, and said tube has a closure portion toward said piston, said tube closure portion being sized and positioned such that when said piston is in position toward an end limit of travel toward said body first end, said tube closure portion at least partially blocks the flow of fluid through said second orifice.

16. The actuator of claim 13 wherein said tube first opening includes first and second orifices, said first orifice being positioned in a sidewall of said tube toward an end thereof away from said piston, and said central aperture has a reduced-diameter interior sidewall portion toward said shaft free end, said reduced-diameter sidewall portion being sized and positioned such that when said piston is in position toward an end limit of travel toward said body second end, said first orifice is within said reduced-diameter sidewall portion and said reduced-diameter sidewall portion substantially blocks the flow of fluid through said first orifice while permitting continued flow through said second orifice.

17. The actuator of claim 13 wherein said shaft first fluid conduit includes a first orifice toward said shaft free end, and said tube has a closure portion toward said piston, said closure portion being sized and positioned such that when said piston is in position toward an end limit of travel toward said body first end, said closure portion least partially blocks the flow of fluid through said first orifice.

18. The actuator of claim 13 wherein said shaft first fluid conduit includes first and second orifices, said first orifice being positioned in a sidewall of said central aperture at an end portion thereof toward said shaft free end opening, and the actuator includes a seal located within said central aperture and axially positioned between said first orifices and an end limit of travel position of said tube first opening reached when said piston reaches an end limit of travel toward said body second end, said seal providing a fluid-tight seal between said shaft and said tube, said tube having an enlarged-diameter exterior sidewall portion toward said piston, said enlarged-diameter sidewall portion being sized and positioned such that when said piston is in position toward an end limit of travel toward said body first end, said first orifice is within said enlarged-diameter sidewall portion and said enlarged-diameter sidewall portion substantially blocks the flow of fluid through said first orifice while permitting continued flow through said second orifice.

19. The actuator of claim 18 wherein said tube first opening includes third and fourth orifices, said third orifice being positioned in a sidewall of said tube toward an end thereof away from said piston, and said central aperture has a reduced-diameter interior sidewall portion toward said shaft free end, said reduced-diameter sidewall portion being sized and positioned such that when said piston is in position toward an end limit of travel toward said body second end, said first orifice is within said reduced-diameter sidewall portion and said reduced-diameter sidewall portion substantially blocks the flow of fluid through said third orifice while permitting continued flow through said fourth orifice.

20. A fluid-powered rotary actuator to produce relative rotational movement between a rotatable first member and a second member, comprising:

a body having a longitudinal axis, and first and second ends, said body being adapted for coupling to the first member to transfer rotational force thereto;

a piston having a first side toward said body first end and a second side toward said body second end, with a central aperture therethrough, said piston being mounted for reciprocal longitudinal movement within said body in response to selective application of pressurized fluid thereto;

a shaft mounted for coaxial rotation with said body, said shaft having a first portion positioned at and extending axially outward of said body beyond said body first end for coupling to the second member to transfer rotational force thereto, and a stub shaft second portion extending longitudinally and generally coaxially within said body toward said body second end and terminating in a free end positioned between said piston first side and said body first end, said shaft having an elongated central aperture extending coaxially with said shaft having an elongated central aperture extending coaxially with said shaft and said piston, said central aperture having an opening at said shaft free end, said shaft further having a first fluid conduit formed therein to provide fluid communication between said piston first side and a first port formed in said shaft at a location exterior of said body, and a second fluid conduit formed therein to provide fluid communication between said central aperture and a second port formed in said shaft at a location exterior of said body;

a fluid-transfer tube carried by said piston as said piston moves within said body, said tube extending through said shaft free end opening and into said shaft central aperture for reciprocal longitudinal movement therewithin as said piston longitudinally reciprocates within said body, said tube having a fluid conduit with a first opening in a free end portion of said tube positioned within said central aperture and a second opening at a position in fluid communication with said piston second side to provide fluid communication between said second port and said piston second side, the selective application of pressurized fluid to said first port applying pressurized fluid to said piston first side to more said piston toward said body second end, and the selective application of pressurized fluid to said second port applying pressurized fluid to said piston second side to move said piston toward said body first end; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement of said body relative to said shaft, and longitudinal movement of said piston toward the other of said body first or second ends into counterclockwise rotational movement of said body relative to said shaft; whereby rotational movement of the first member relative to the secondary member results.

21. The actuator of claim 20 wherein said tube first opening includes a first orifice in said tube toward an end thereof away from said piston, and said shaft second portion has a closure portion toward said shaft free end, said shaft closure portion being sized and positioned such that when said piston is in position toward an end limit of travel toward said body second end, said shaft closure portion at least partially blocks the flow of fluid through said first orifice.

22. The actuator of claim 21 wherein said shaft first fluid conduit includes a second orifice toward said shaft free end, and said tube has a closure portion toward said piston, said tube closure portion being sized and positioned such that when said piston is in position toward an end limit of travel toward said body first end, said tube closure portion at least partially blocks the flow of fluid through said second orifice.

23. The actuator of claim 20 wherein said tube first opening includes first and second orifices, said first orifice being positioned in a sidewall of said tube toward an end thereof away from said piston, and said central aperture has a reduced-diameter interior sidewall portion toward said shaft free end, said reduced-diameter sidewall portion being sized and positioned such that when said piston is in position toward an end limit of travel toward said body second end, said first orifice is within said reduced-diameter sidewall portion and said reduced-diameter sidewall portion substantially blocks the flow of fluid through said first orifice while permitting continued flow through said second orifice.

24. The actuator of claim 20 wherein said shaft first fluid conduit includes a first orifice toward said shaft free end, and said tube has a closure portion toward said piston, said closure portion being sized and positioned such that when said piston is in position toward an end limit of travel toward said body first end, said closure portion at least partially blocks the flow of fluid through said first orifice.

25. The actuator of claim 20 wherein said shaft first fluid conduit includes first and second orifices, said first orifice being positioned in a sidewall of said central aperture at an end portion thereof toward said shaft free end opening, and the actuator includes a seal located within said central aperture and axially positioned between said first orifices and an end limit of travel position of said tube first opening reached when said piston reaches an end limit of travel toward said body second end, said seal providing a fluid-tight seal between said shaft and said tube, said tube having an enlarged-diameter exterior sidewall portion toward said piston, said enlarged-diameter sidewall portion being sized and positioned such that when said piston is in position toward an end limit of travel toward said body first end, said first orifice is within said enlarged-diameter sidewall portion and said enlarged-diameter sidewall portion substantially blocks the flow of fluid through said first orifice while permitting continued flow through said second orifice.

26. The actuator of claim 25 wherein said tube first opening includes third and fourth orifices, said third orifice being positioned in a sidewall of said tube toward an end thereof away from said piston, and said central aperture has a reduced-diameter interior sidewall portion toward said shaft free end, said reduced-diameter sidewall portion being sized and positioned such that when said piston is in position toward an end limit of travel toward said body second end, said first orifice is within said reduced-diameter sidewall portion and said reduced-diameter sidewall portion substantially blocks the flow of fluid through said third orifice while permitting continued flow through said fourth orifice.

27. A fluid-powered rotary actuator to produce relative rotational movement between a rotatable first member and a second member, comprising:

a body having a longitudinal axis, and first and second ends, said body being adapted for coupling to the first member to transfer rotational force thereto;

a piston having a first side toward said body first end and a second side toward said body second end, with a central aperture therethrough, said piston being mounted for reciprocal longitudinal movement within said body in response to selective application of pressurized fluid thereto;

a shaft mounted for coaxial rotation with said body, said shaft having a first portion positioned at and extending axially outward of said body beyond said body first end for coupling to the second member to transfer rotational force thereto, and a stub shaft second portion extending longitudinally and generally coaxially within said body toward said body second end and terminating in a free end positioned between said piston first side and said body first end, said shaft further having a first fluid conduit formed therein to provide fluid communication between said piston first side and a first port formed in said shaft at a location exterior of said body, and a second fluid conduit formed therein to provide fluid communication between an opening at said shaft free end and a second port formed in said shaft at a location exterior of said body;

a fluid transfer tube supported by said shaft second portion in coaxial alignment with said piston, said tube extending from said shaft free end through said piston central aperture to permit reciprocal longitudinal movement of said piston within said body, said tube having a fluid conduit with a first opening in an end portion of said tube positioned toward said shaft free end in fluid communication with said shaft opening at said shaft free end and a second opening at a position in fluid communication with said piston second side to provide fluid communication between said second port and said piston second side, the selective application of pressurized fluid to said first port applying pressurized fluid to said piston first side to move said piston toward said body second end, and the selective application of pressurized fluid to said second port applying pressurized fluid through said tube to said piston second side to move said piston toward said body first end;

a torque-transmitting member mounted for reciprocal longitudinal movement within said body, said torque-transmitting member engaging said body and said shaft second portion to translate longitudinal movement of said piston toward one of said body first or second ends into clockwise relative rotational movement of said body relative to said shaft, and longitudinal movement of said piston toward the other of said body first or second ends into counterclockwise rotational movement of said body relative to said shaft, whereby rotational movement of the first member relative to the secondary member results.

28. The actuator of claim 27 wherein said tube first opening includes a first orifice in said tube toward an end thereof away from said shaft second portion, and said piston has a first closure portion sized and positioned such that when said piston is in position toward an end limit of travel toward said body second end, said portion and said sidewall portion at least partially blocks the flow of fluid through said first orifice.

29. The actuator of claim 28 wherein said shaft first fluid conduit includes a second orifice toward said shaft free end, and said piston has a second closure portion sized and positioned such that when said piston is in position toward an end limit of travel toward said body first end, said second closure portion at least partially blocks the flow of fluid through said second orifice.

30. The actuator of claim 27 wherein said tube first opening includes first and second orifices, said first orifice being positioned in a sidewall of said tube toward an end thereof away from said shaft second portion, and said piston central aperture has an interior sidewall portion sized and positioned such that when said piston is in position toward an end limit of travel toward said body second end, said first orifice is within said sidewall portion and said sidewall portion substantially blocks the flow of fluid through said first orifice while permitting continued flow through said second orifice.

31. The actuator of claim 27 wherein said shaft first fluid conduit includes a first orifice toward said shaft free end, and said piston has a closure portion sized and positioned such that when said piston is in position toward an end limit of travel toward said body first end, said closure portion at least partially blocks the flow of fluid through said first orifice.

32. The actuator of claim 27 wherein said shaft first fluid conduit includes first and second orifices, said first orifice being positioned toward said shaft free end, and said piston having a valve portion toward said shaft free end, said valve portion being sized and positioned such that when said piston is in position toward an end limit of travel toward said body first end, said valve portion substantially blocks the flow o fluid through said first orifice while permitting continued flow through said second orifice.

33. The actuator of claim 32 wherein said tube first opening includes third and fourth orifices, said third orifice being positioned in a sidewall of said tube toward an end thereof away from said shaft second portion, and said piston central aperture has an interior sidewall portion sized and positioned such that when said piston is in position toward an end limit of travel toward said body second end, said first orifice is within said sidewall portion and said sidewall portion substantially blocks the flow of fluid through said third orifice while permitting continued flow through said fourth orifice.

34. A fluid-powered rotary actuator attachable to a support member, the rotary actuator being usable with a work implement having a selectively operable work implement actuator associated therewith, the work implement actuator having a pair of fluid ports for operation of the work implement actuator in response to selective application of pressurized fluid thereto, comprising:

a body having a longitudinal axis, and first and second ends, said body having a first attachment portion configured for attachment of the work implement thereto for rotation with said body, and a second attachment portion configured for attachment of the work implement actuator thereto for application of a counter force upon actuation of the work implement actuator to operate the work implement;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being adjacent to said body first end and said first end portion of said shaft first portion being axially outward of said body first end, said shaft first portion also having an intermediate portion between said first and second end portions of said shaft first portion and axially outward of said body first end, said second end portion of said shaft first portion having an axially outward-facing bearing race formed thereon extending circumferentially thereabout, said first end portion of said shaft first portion being threaded and said intermediate portion of said shaft first portion having at least one first torque-transmitting elements;

a mounting member adapted for coupling to the support member to transfer rotational force thereto, said mounting member having an aperture with said intermediate portion of said shaft first portion extending therethrough and at least one second torque-transmitting element engaging said first torque-transmitting element of said intermediate portion to transmit rotational force therebetween while permitting adjusting longitudinal movement of said mounting member relative to said shaft first portion, said mounting member having an axially inward-facing bearing race formed thereon about said mounting member aperture;

an adjustable retaining nut threadably mounted on said threaded first end portion of said shaft first portion axially outward of said mounting member and engaging said mounting member, said retaining nut being adjustably rotatable on said threaded first end portion;

an annular bearing carrier mounted coaxially with and fixedly attached to said body at said body first end axially outward of said body first end, said carrier having a central aperture with said shaft first portion extending therethrough for rotation of said carrier relative to said shaft first portion, said carrier further having an axially inward-facing bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and an axially outward-facing bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable rotation of said retaining nut on said threaded first end portion of said shaft first portion to longitudinally move said retaining nut inward preloading said first and second sets of races, said carrier further having first and second fluid conduits with said carrier first fluid conduit being in fluid communication with said first set of races and with said carrier second fluid conduit being in fluid communication with said second set of races, said carrier first and second fluid conduits terminating in carrier first and second fluid ports, respectively, in an outer circumferential sidewall of said carrier, each connectable to one of the pair of work implement actuator ports;

one or more bearings seated in each of said first and second sets of races;

a shaft first fluid conduit extending from a shaft outer first port through said shaft first portion and terminating in a shaft inner first port in alignment and fluid communication with said first set of races and remaining in fluid communication therewith as said carrier rotates relative to said shaft first portion, said shaft outer first port being connectable to the source of pressurized fluid;

a shaft second fluid conduit extending from a shaft outer second port through said shaft first portion and terminating in a shaft inner second port in alignment and fluid communication with said second set of races and remaining in fluid communication therewith as said carrier rotates relative to said shaft first portion, said shaft outer second port being connectable to the source of pressurized fluid;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between said body carrying the work implement and the support member results.

35. A fluid-powered rotary actuator attachable to a support member and usable with a work implement having a selectively operable work implement actuator associated therewith, the work implement actuator having a pair of fluid ports for operation of the work implement actuator in response to selective application of pressurized fluid thereto from a source of pressurized fluid, comprising:

a body having a longitudinal axis, and first and second ends, said body being adapted for coupling of the work implement thereto for rotation with said body;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being toward said body first end and said first end portion of said shaft first portion being axially outward of said body first end, said shaft first portion also having an intermediate portion between said first and second end portions of said shaft first portion and axially outward of said body first end, said second end portion of said shaft first portion having an axially outward-facing bearing race formed thereon extending circumferentially thereabout, said intermediate portion of said shaft first portion having at least one first torque-transmitting elements;

a mounting member adapted for coupling to the support member to transfer rotational force thereto, said mounting member having an aperture with said intermediate portion of said shaft first portion extending therethrough and at least one second torque-transmitting element engaging said first torque-transmitting element of said intermediate portion to transmit rotational force therebetween while permitting adjusting longitudinal movement of said mounting member relative to said shaft first portion, said mounting member having an axially inward-facing bearing race formed thereon about said mounting member aperture;

an adjustable member mounted on said first end portion of said shaft first portion axially outward of said mounting member and engaging said mounting member to limit axially outward movement of said mounting member relative to said shaft first portion, said adjustable member being adjustably axially position able on said first end portion;

an annular bearing carrier mounted coaxially with and fixedly attached to said body at said body first end axially outward of said body first end, said carrier having a central aperture with said shaft first portion extending therethrough for rotation of said carrier relative to said shaft first portion, said carrier further having an axially inward-facing bearing race formed thereon about said carrier aperture and confronting and corresponding to said second end portion bearing race to form a first set of races extending circumferentially about said shaft first portion at said body first end to rotatably support said shaft and limit outward longitudinal movement of said shaft, and an axially outward-facing bearing race formed thereon about said carrier aperture and confronting and corresponding to said mounting member bearing race to form a second set of races extending circumferentially about said shaft first portion axially outward of said first set of races to rotatably support said shaft and limit inward longitudinal movement of said shaft, said first and second sets of races providing the rotational support for said shaft relative to said body at a location at or outward of said body first end, with adjustable axial inward positioning of said adjustable member on said first end portion of said shaft first portion preloading said first and second sets of races, said carrier further having first and second fluid conduits with said carrier first fluid conduit being in fluid communication with said first set of races and said carrier second fluid conduit being in fluid communication with said second set of races, said carrier first and second fluid conduits terminating in carrier first and second fluid ports, respectively, each connectable to one of the pair of work implement actuator ports;

one or more bearings seated in each of said first and second sets of races;

a shaft first fluid conduit extending from a shaft outer first port through said shaft first portion and terminating in a shaft inner first port in alignment and fluid communication with said first set of races and remaining in fluid communication therewith as said carrier rotates relative to said shaft first portion, said shaft outer first port being connectable to the source of pressurized fluid;

a shaft second fluid conduit extending from a shaft outer second port through said shaft first portion and terminating in a shaft inner second port in alignment and fluid communication with said second set of races and remaining in fluid communication therewith as said carrier rotates relative to said shaft first portion, said shaft outer second port being connectable to the source of pressurized fluid;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between said body with the work implement coupled thereto the first and the support member results.

36. A fluid-powered rotary actuator to produce relative rotational movement between first and second members, comprising:

a body having a longitudinal axis, and first and second ends, said body being adapted for coupling to the first member to transfer rotational force thereto;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being adjacent to said body first end and said first end portion of said shaft first portion being axially outward of said body first end, said first end portion of said shaft first portion being threaded and said second end portion of said shaft first portion having at least one first torque-transmitting element;

a mounting member adapted for coupling to the second member to transfer rotational force thereto, said mounting member having an aperture with said second end portion of said shaft first portion extending therethrough and at least one second torque-transmitting element engaging said first torque-transmitting element of said second end portion to transmit rotational force therebetween, said mounting member having a bearing race formed thereon about said mounting member aperture;

a retaining nut threadably mounted on said threaded first end portion of said shaft first portion axially outward of said mounting member and engaging said mounting member, said retaining nut being rotatable on said threaded first end portion to prevent axially outward movement of said mounting member on said second end portion of said shaft first portion;

an annular bearing carrier mounted coaxially with and fixedly attached to said body at said body first end axially outward of said body first end, said carrier having a central aperture with said shaft first portion extending therethrough for rotation of said carrier relative to said shaft first portion, said carrier having a bearing race formed thereon about said carrier aperture and confronting and corresponding to said mounting member bearing race to form a set of races extending circumferentially about said shaft first portion at said body first end to rotatably support said shaft and limit longitudinal movement of said shaft, said set of races providing the rotational support for said shaft relative to said body at a location at or outward of said body first end;

one or more bearings seated in said set of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between the first and second members results.

37. A fluid-powered rotary actuator to produce relative rotational movement between first and second members, comprising:

a body having a longitudinal axis, and first and second ends, said body being adapted for coupling to the first member to transfer rotational force thereto;

a shaft having a first portion positioned at and extending axially outward of said body beyond said body first end, and a second portion extending longitudinally and generally coaxially within said body toward said body second end, said shaft first portion having first and second end portions with said second end portion of said shaft first portion being toward said body first end and said first end portion of said shaft first portion being axially outward of said body first end, said second end portion of said shaft first portion having at least one first torque-transmitting element;

a mounting member adapted for coupling to the second member to transfer rotational force thereto, said mounting member having an aperture with said second end portion of said shaft first portion extending therethrough and at least one second torque-transmitting element engaging said first torque-transmitting element of said second end portion to transmit rotational force therebetween, said mounting member having a bearing race formed thereon about said mounting member aperture;

a retaining member mounted on said first end portion of said shaft first portion axially outward of said mounting member and engaging said mounting member to limit axially outward movement of said mounting member relative to said shaft first portion;

an annular bearing carrier mounted coaxially with and fixedly attached to said body at said body first end axially outward of said body first end, said carrier having a central aperture with said shaft first portion extending therethrough, said carrier having a bearing race formed thereon about said carrier aperture and confronting and corresponding to said mounting member bearing race to form a set of races extending circumferentially about said shaft first portion at said body first end to rotatably support said shaft and limit longitudinal movement of said shaft, said set of races providing the rotational support for said shaft relative to said body at a location at or outward of said body first end;

one or more bearings seated in said set of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft second portion to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, whereby relative rotational movement between the first and second members results.

* * * * *

UNITED STATES PATENT AND TRADEMARK OFFICE

CERTIFICATE OF CORRECTION

PATENT NO. : 5,309,816

DATED : May 10, 1994

INVENTOR(S) : Paul P. Weyer

It is certified that error appears in the above-identified patent and that said Letters Patent is hereby corrected as shown below:

In column 18, claim 3, line 50, please delete "forced" and substitute therefor --formed--.

In column 21, claim 8, line 11, after "as" and before "fluid", please insert --pressurized--.

In column 29, claim 20, line 67, please delete "more" and substitute therefor --move--.

In column 32, claim 32, line 57, please delete "o" and substitute therefor --of--.

Signed and Sealed this

Seventeenth Day of January, 1995

*Attest:*

*Attesting Officer*

Bruce Lehman

BRUCE LEHMAN

*Commissioner of Patents and Trademarks*